US009859614B2

(12) United States Patent
Almog

(10) Patent No.: US 9,859,614 B2
(45) Date of Patent: Jan. 2, 2018

(54) MULTIPLE ANTENNA SYSTEM

(71) Applicant: ELTA SYSTEMS LTD., Ashdod (IL)

(72) Inventor: Benyamin Almog, Beit Arie (IL)

(73) Assignee: ELTA SYSTEMS LTD., Ashdod (IL)

( * ) Notice: Subject to any disclaimer, the term of this patent is extended or adjusted under 35 U.S.C. 154(b) by 495 days.

(21) Appl. No.: 14/376,894

(22) PCT Filed: Feb. 7, 2013

(86) PCT No.: PCT/IL2013/050116
§ 371 (c)(1),
(2) Date: Aug. 6, 2014

(87) PCT Pub. No.: WO2013/118123
PCT Pub. Date: Aug. 15, 2013

(65) Prior Publication Data

US 2015/0015448 A1 Jan. 15, 2015

(30) Foreign Application Priority Data

Feb. 7, 2012 (IL) ..... 217982

(51) Int. Cl.
*H01Q 21/12* (2006.01)
*H01Q 21/10* (2006.01)
(Continued)

(52) U.S. Cl.
CPC ..... *H01Q 1/521* (2013.01); *H01Q 9/18* (2013.01); *H01Q 21/10* (2013.01); *H01Q 21/24* (2013.01); *H01Q 21/28* (2013.01)

(58) Field of Classification Search
CPC ..... H01Q 9/20; H01Q 1/521
(Continued)

(56) References Cited

U.S. PATENT DOCUMENTS 3,879,735 A * 4/1975 Campbell ..... H01Q 21/28 343/792
4,359,743 A 11/1982 DeSantis
(Continued)

FOREIGN PATENT DOCUMENTS

CN 1239840 12/1999
EP 0817312 A2 1/1998
(Continued)

OTHER PUBLICATIONS

Gao Q et al: "Application of metamaterials to ultra-thin radar-absorbing material design", Electronics Letters, IEE Stevenage, GB, vol. 41, No. 17, Aug. 18, 2006, pp. 936-937.

*Primary Examiner* — Graham Smith
(74) *Attorney, Agent, or Firm* — Browdy and Neimark, PLLC

(57) ABSTRACT

The present invention relates to an antenna system including at least two antenna modules operable for transmitting and/or receiving radiation in certain common frequency band. The at least two antenna modules are collinearly arranged along a common axis so as to provide low gain along the axis, and are spaced apart from one another along this axis by a distance of at least a few nominal wavelengths of the common frequency band. Each two locally adjacent antenna modules of the at least two antenna modules operate with substantially mutually orthogonal polarizations of radiation, thereby suppressing electromagnetic coupling between the antenna modules in the common frequency band.

20 Claims, 12 Drawing Sheets

(51) Int. Cl.

| | |
|---|---|
| ***H01Q 21/00*** | (2006.01) |
| ***H01Q 1/52*** | (2006.01) |
| ***H01Q 21/24*** | (2006.01) |
| ***H01Q 9/18*** | (2006.01) |
| ***H01Q 21/28*** | (2006.01) |

(58) Field of Classification Search
USPC ..... 343/813, 827, 726
See application file for complete search history.

(56) References Cited

U.S. PATENT DOCUMENTS

| | | | | |
|---|---|---|---|---|
| 5,923,296 | A | 7/1999 | Sanzgiri et al. | |
| 7,369,879 | B1 | 5/2008 | Steigerwald et al. | |
| 2004/0032363 | A1 | 2/2004 | Schantz et al. | |
| 2006/0227062 | A1 | 10/2006 | Francque et al. | |
| 2009/0224990 | A1* | 9/2009 | Cezanne ..... | H01Q 1/24 343/726 |

FOREIGN PATENT DOCUMENTS

| | | | |
|---|---|---|---|
| EP | 1768211 | A1 | 3/2007 |
| EP | 2139064 | A1 | 12/2009 |
| EP | 2178165 | A1 | 4/2010 |
| FR | 2916308 | A1 | 11/2008 |
| GB | 1247629 | A | 9/1971 |
| WO | 9913531 | A1 | 3/1999 |
| WO | 2004017462 | A1 | 2/2004 |
| WO | 2011043851 | | 4/2011 |

* cited by examiner

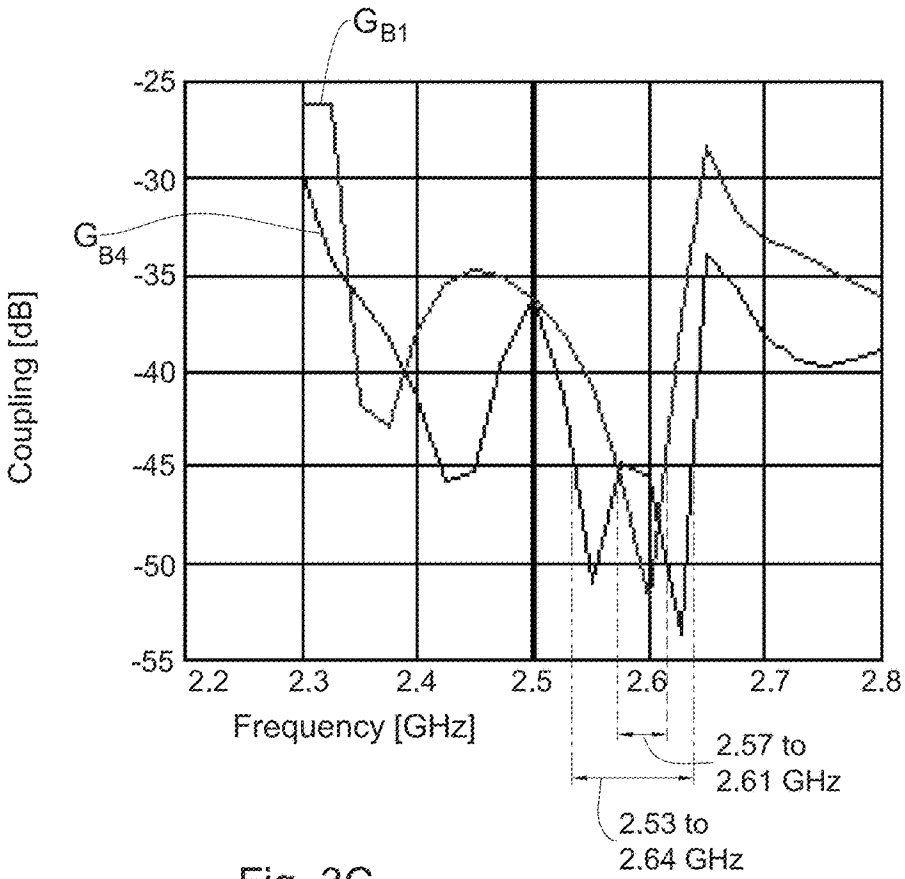
Fig. 3C
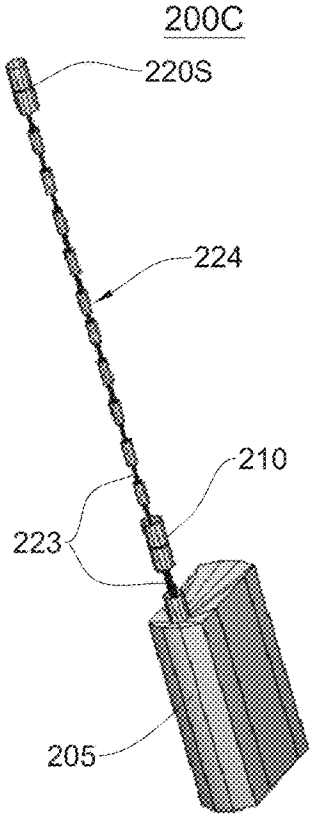

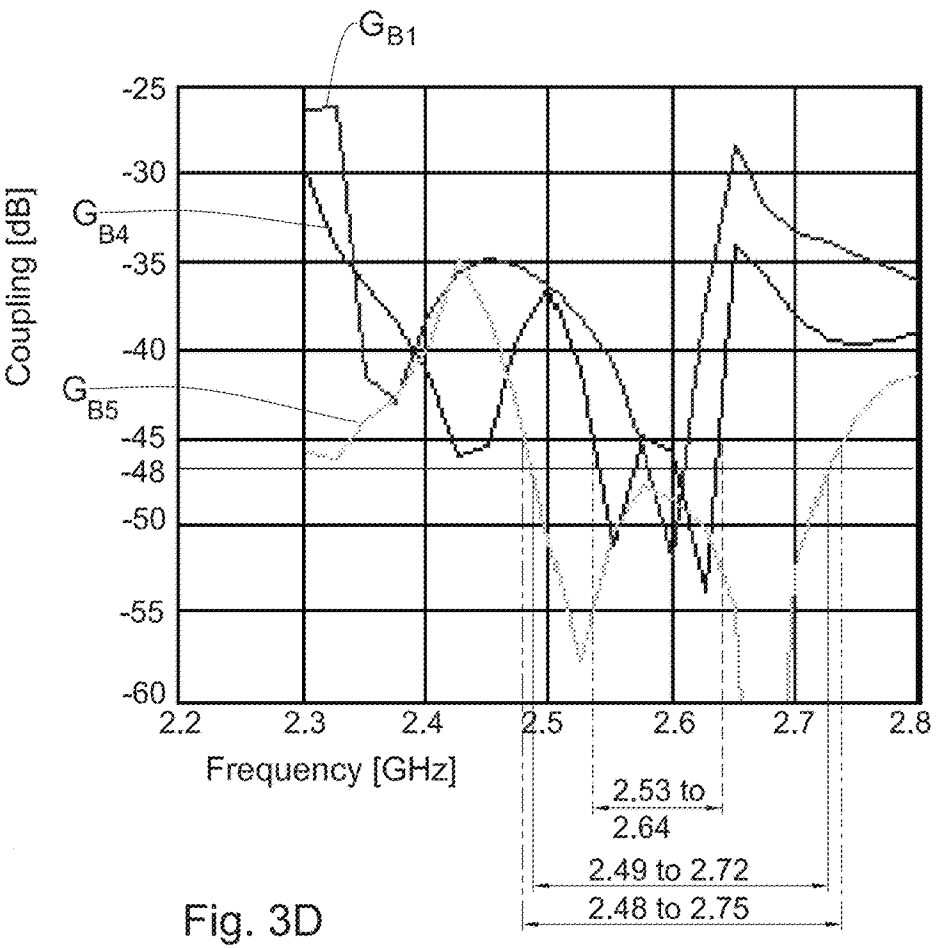
Fig. 3D
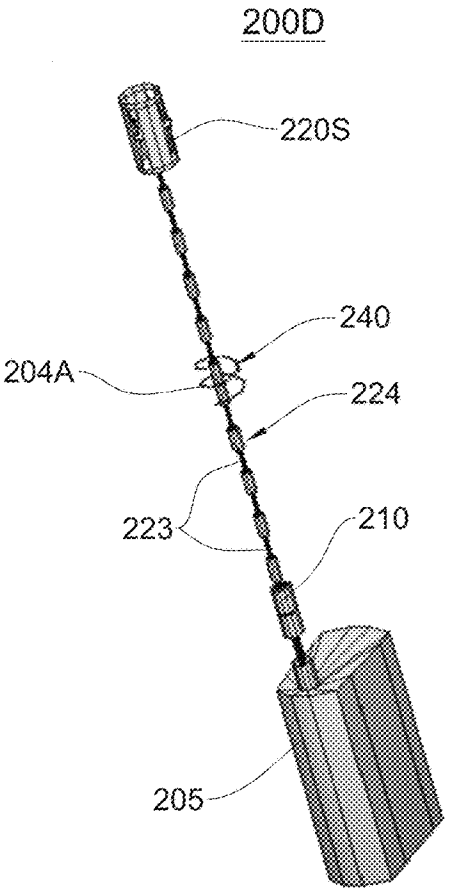

MULTIPLE ANTENNA SYSTEM

FIELD AND BACKGROUND OF THE INVENTION

This invention is generally in the field of antennas, and relates to a multiple antenna system configured for reducing cross talk between neighboring antennas.

Various antenna systems utilize multiple antenna elements to transmit and/or receive electromagnetic signals simultaneously. In cases where the antenna elements are located in relative proximity, substantial coupling and crosstalk between the proximate antennas may introduce noise in the signals transmitted and/or received thereby. Conventional techniques, for reducing the isolation between the antennas include increasing a distance between the antennas and/or utilizing electromagnetic radiation shields between the antennas including for example absorbing materials and/or conductive plates. Such techniques are generally associated with large dimensions and/or weight of the system and/or with low isolation between the antennas which make them less suitable for certain applications

GENERAL DESCRIPTION

There is a need in the art for an antenna system comprising an array (generally at least two) antenna modules operable at substantially the same wavelength range (generally, having overlapping wavelength ranges) while maintaining high electromagnetic isolation between the antennas and small dimensions of the antenna system. Specifically, there is a need in the art for an antenna system enabling simultaneous transmission and reception in substantially similar wavelengths while proving low crosstalk and low electromagnetic coupling between the antennas, thereby allowing high signal to noise ratio to be obtained in the transmitted and/or received signals. Particularly, in various applications, such as cellular networks, there is a need for an omni-directional antenna system providing wide azimuthal coverage (e.g. of) 360° and enabling simultaneous transmission and reception of signals at the similar wavelengths and with low induced noise.

The term noise is referred to herein in connection with undesired signals which may be induced due to coupling between the antennas. In other words such noise may appear as a signal received or transmitted by one antenna due to signal/voltage in the port/terminal of other antennas. Accordingly, the terms signal to noise ratio (SNR) and signal to interference ratio (SIR) are used herein interchangeably to indicate a ratio between the desired signal to be received/transmitted by the antenna and an undesired signal (interfering noise) which is induced due to the coupling between the antenna and other antennas.

Many conventional antenna systems utilize dipole antennas to provide high transmission efficiency as well as high gain in the azimuthal plane perpendicular to the antenna's longitudinal axis. In applications utilizing multiple antennas for simultaneous reception and/or transmission of multiple signals, electromagnetic (EM) coupling and crosstalk between the antennas may be a source of substantial noise deteriorating the signal quality and impairing the operation of the antennas.

EM coupling between nearby antenna elements (locally adjacent antennas) is dictated by several factors such as the distance between the antenna elements/modules and their spatial performance (spatial transmission pattern/gain-function). Utilizing the conventional technique for providing low coupling between the antennas is generally associated with large dimensions (form factor) of the antenna system and also possibly with large weight. This is because, for high isolation to be obtained, large distance between the antennas, of more than few wavelengths of the operative antenna wavelength, should be provided. Additionally, when electromagnetic radiation shields (conductive/absorbing plates) are used to decouple between the antennas, such shields have generally large dimensions (e.g. exceeding several wavelengths).

The EM coupling (i.e. crosstalk) between two antennas may be defined by the ratio between the voltage generated on the terminal of one antenna due to voltage applied to a second antenna during either transmitting or receiving operational mode of the other antenna. Specifically, the coupling between two antennas may be measured in the logarithmic decibel units (dB) and defined as:

$$C_{db}=20\ \mathrm{Log}_{10}(V_1/V_2) \qquad \text{Eq. (1)}$$

where $C_{db}$ is a measure of the EM coupling between the antennas in dB, $V_2$ is the voltage generated on the first antenna during transmission and/or reception of EM radiation, and $V_1$ is a voltage affected/induced on the terminal of the second neighboring antenna in response to the voltage affected on the first antenna.

Considering for example a first transmitting antenna with time harmonic (sinusoidal) voltage $V_2$ applied to its terminal, the applied voltage converted by said antenna into EM radiation provides the following power P transmitted by the antenna:

$$P=\left|\frac{V}{2Z}\right|^2\mathrm{Re}(Z) \qquad \text{Eq. (2)}$$

where Z is the antenna's impedance.

For an isotropic antenna, the power transmitted is equally distributed in all directions. Accordingly, the power density $S_0$ radiated by such isotropic antenna depends only on the distance r from antenna and is equally distributed on a spherical shell at this distance, namely:

$$S_0(r)=P/4\pi r^2. \qquad \text{Eq. (3)}$$

A non-isotropic source/antenna is associated with a spatial Antenna Gain ($G(\theta,\phi)$) function which is indicative of the spatial radiation pattern of the antenna in the far field. The antenna gain is generally determined, inter alia, by the physical structure of the radiating elements of the antenna. The antenna gain is a measure of the actual power density S provided by a specific antenna for certain coordinates (at distance r and direction given by θ and ϕ) as compared to the power density $S_0$ that would be provided to the same distance r by an isotropic antenna/source. Thus, considering the antenna gain function $G(\theta,\phi)$ in logarithmic dB units, it is provided by:

$$G(\theta,\phi)_{dB}=10\ \mathrm{Log}_{10}(S(r,\theta,\phi)/S_0(r)) \qquad \text{Eq. (4)}$$

The far field power density S radiated by an antenna is generally related to the local electric field E generated at the same place, as follows:

$$S(r,\theta,\phi)=E^2/\eta_0 \qquad \text{Eq. (5)}$$

where $\eta_0$ is the free space impedance $\eta_0=120\pi$ and far field is considered here in a distance of few or more wavelengths away from the antenna.

For a given electric field E in the vicinity of the antenna, the 'open circuit voltage' ($Y_{oc}$) induced on the antenna (when a load $Z_r$ is omitted/disconnected from the antennas terminal) is generally linearly related to the projection of the incident E field on the vector effective length of the antenna $l_e$:

$$V_{oc}=E^{inc}\cdot l_e. \quad \text{Eq. (6)}$$

Thus, in view of the above, the theoretical EM coupling between two specific antennas may be determined based on the relative positions between the antennas, and their specific properties including their structures (gain functions, lengths and impedances). However, it should be noted that in practice, the EM coupling between two antennas is typically greater than a theoretical figure that would be calculated utilizing the above equations. This is at least because of auxiliary elements such as signal feeding structures and transmission lines which are used to couple the antennas to their transmitters/receivers and which may by themselves transmit and/or receive residual EM radiation in their vicinity.

The present invention provides a novel antenna system including multiple (generally, at least two) isolated antennas with reduced crosstalk between them. The invention utilizes several techniques to overcome and reduce the effective EM coupling between the antennas. In simulations performed with the system of the invention, which are described below, several simulation techniques where used based on a simplified model taking into account the above described theoretical factors of EM coupling. Additionally, more accurate simulations were also performed utilizing a known in the art Method of Moments (MoM) technique. The MoM based simulation is typically indicative of the higher EM coupling between the antennas (which is practically the case), as compared to that of the simplified model. The principles of the invention provides for EM coupling reduction in practical antenna system configuration that can be described by the MoM-based simulation.

Thus, the present invention provides an antenna system including at least two antenna modules which are arranged and configured and operable to provide improved isolation between them. Under given operational requirements, the isolation between the antennas is improved/maximized by arranging and utilizing the antenna modules in accordance with their spatial gain functions. Additionally, the characteristics of the medium between the antennas can be controlled (e.g. by providing parasitic antennas) and/or signal feeding to/from the antenna can be controlled.

The system of the present invention also allows to increase the isolation between two omni-directional antennas (reduce the crosstalk between them) while maintaining as small as possible distance between them. According to the invention, the low EM coupling is achieved by selecting the antenna modules having at least one endfire direction (null direction) at which their radiation patterns (gain function) are relatively low (null direction). The antennas may be arranged collinearly to direct their endfire towards the neighboring antennas and thus contribute in the crosstalk reduction between the antennas. In addition, each pair of neighboring collinear antenna modules may be configured with mutually orthogonal polarizations of the EM fields transmitted/received thereby thus further reducing the crosstalk between the antennas.

Moreover, the signal feeding structures, by which the antennas are connected to their transmitter(s) and/or receivers, may include induced current suppression utility associated/connected to a transmission line defined by one or more of the feeding structures For example such an induced current suppression utility of a signal feeding structure may include one or more quarter wave transformers accommodated on the transmission line. The induced current suppression utility may provide significant improvement to the isolation between the antennas modules by reflecting back the currents which are induced on the transmission line along its passage in the vicinity of another antenna of the system.

Additionally, in some cases, the present invention utilizes parasitic antenna circuits arranged in the medium surrounding one or more antennas, between them, and/or in the vicinity of transmission lines/modules associated with the antennas. The parasitic antenna circuits may be used to absorb and/or reflect and/or scatter some residual EM energy radiated by the antenna(s) and/or feeding structures, and by that reduce the coupling between the antennas. Such parasitic antenna circuits may be passive antennas arranged in the medium while being disconnected from a signal generator/receiver.

To this end, the invention utilizes a combination of one or more of the following techniques to reduce the coupling between the antennas. This is achieved by adjusting the structure and arrangement of the antennas, adjusting the polarization of the antennas, and possibly also utilizing absorbing/scattering of EM radiation and/or controlling the phase of the radiation. The invention provides for high isolation and low crosstalk between the antennas in the ordered of about −45 to −50 dBs (~50 dB isolation) with short distances between the antennas (e.g. few wavelengths apart). In some embodiments of the invention the distance between the antenna modules is at most five nominal wavelengths of the operative wavelength band of the antennas.

Thus, according to a broad aspect of the invention, there is provided an antenna system comprising at least two antenna modules having a certain common frequency band of electromagnetic (EM) radiation, wherein:

said at least two antenna modules are collinearly arranged along a common axis so as to provide low gain along said axis;

said at least two antenna modules are spaced apart from one another along said axis by a distance of at least a few nominal wavelengths corresponding to said frequency band; and each two locally adjacent antenna modules of said at least two antenna modules operate with substantially mutually orthogonal polarizations of radiation, thereby suppressing EM coupling between the antenna modules in said common frequency band.

Preferably, the locally adjacent antenna modules comprise a magnetic dipole (MD) antenna module and an electric dipole (ED) antenna module, each of said MD and ED antenna modules is characterized by a toroidal EM radiation pattern coaxial with respect to said common axis, thereby providing the low gain along said axis.

According to another broad aspect of the invention, there is provided an antenna system comprising:

at least two antenna modules having a certain common frequency band of electromagnetic (EM) radiation, wherein: said at least two antenna modules are collinearly arranged along a common axis so as to provide low gain along said axis; said at least two antenna modules are spaced apart from one another along said axis by a distance of at least a few nominal wavelengths corresponding to said frequency band; and each two locally adjacent antenna modules of said at least two antenna modules operate with substantially mutually orthogonal polarizations of radiation, thereby suppressing EM coupling between the antenna modules in said common frequency band;

at least one signal feeding module associated with at least one of said at least two antenna modules, the signal feeding module defining a transmission line passing through the vicinity of at least one other of said at least two antenna modules, said feeding module comprising a induced current suppression utility adapted for suppressing noise signals induced on said feeding module by said at least one other antenna module, thereby reducing the EM coupling between said at least two antenna modules.

According to yet another broad aspect of the invention, there is provided an antenna system comprising an array of a certain number of antenna modules arranged in a spaced-apart relation along a common axis and comprising the antenna modules of mutually orthogonal polarizations arranged in alternating fashion, such that each two locally adjacent antenna modules are of the mutually orthogonal polarizations.

BRIEF DESCRIPTION OF THE DRAWINGS

In order to understand the invention and to see how it may be carried out in practice, embodiments will now be described, by way of non-limiting example only, with reference to the accompanying drawings, in which:

FIGS. 3B to 3D graphically illustrate the EM coupling between two dipole antennas as obtained according to various embodiments of the invention.

DETAILED DESCRIPTION OF EMBODIMENTS

Figure 1A:
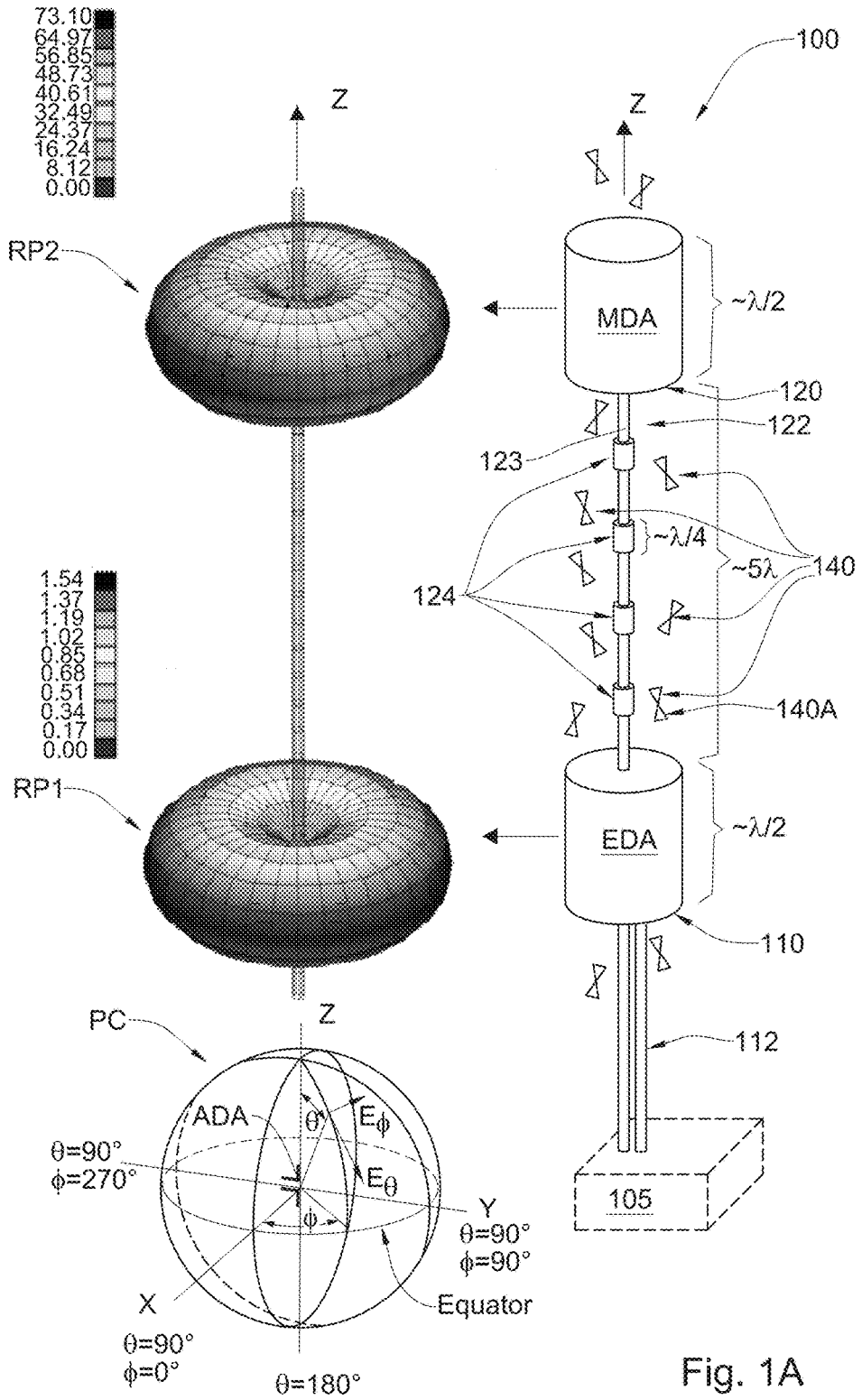
FIG. 1A is a schematic illustration of an antenna system according to an embodiment of the present invention.

Reference is made to FIG. 1A showing a schematic illustration of an antenna system 100 according to an embodiment of the present invention. The antenna system 100 includes at least two antenna modules, 110 and 120, which are each configured and operable for transmitting and/or receiving of electromagnetic (EM) radiation. The operation of the antenna's for either one of reception or transmission, or for both reception and transmission, is generally referred to herein as transceiving operation. The two antenna modules 110 and 120 are configured and operable for transceiving EM radiation at a certain common wavelength band (common frequency band). In order to improve isolation of each of the antennas 110 and 120 from one another (e.g. to reduce crosstalk between the antennas at the common frequency band), the two antenna modules 110 and 120 are collinearly arranged along a common longitudinal axis Z with a certain minimal distance therebetween, which is of at least few nominal wavelengths of said wavelength band. Also, the antenna modules, 110 and 120, are each configured and operable as directive antenna providing low antenna gain for transmitting and/or receiving EM radiation in directions substantially parallel to the longitudinal axis Z. In addition, the two antenna modules 110 and 120 are respectively configured and operable for transceiving EM radiation of substantially mutually orthogonal polarizations. The distance between the antennas 110 and 120 along the Z axis, the transmission beam patterns (there directivities) of the antennas and their substantially mutually orthogonal polarizations are selected to provide for suppressing the EM coupling between antenna modules in the common wavelength band at which the antennas are configured to transmit and/or receive.

According to some embodiments of the present invention, the antenna 110 is configured as an electric dipole antenna EDA providing a first toroidal transmission pattern RP1 and the antennas 120 is configured as a magnetic dipole antenna MDA (e.g. slot antenna) providing a second toroidal transmission pattern RP2 which is dual to the first transmission pattern RP1 in the sense that it has the perpendicular polarization. Generally, in case the antenna system 100 includes an array of more than two antenna modules, these antenna modules comprises antennas of two different types, electric dipole antenna and magnetic dipole antenna, and the arrangement is such that the antennas of different types are arranged in an alternating fashion along the same axis; in other words, each two locally adjacent (neighboring) antennas are of different types.

The first and second antennas are each arranged coaxially with respect to the common longitudinal axis Z and are arranged collinearly with respect to one another along this axis Z such that their toroidal transmission patterns are also laid collinearly with respect to one another and coaxially with respect to the longitudinal axis Z as shown in the figure. Accordingly, each of the antennas is configured to generate a doughnut shape (toroidal) transmission pattern with its null/low gain pole facing the other antenna to reduce the EM coupling between the antennas 110 and 120.

The first and second dual toroidal transmission patterns, RP1 and RP1, are illustrated in the figure to present the "ideal" (far-field) intensity patterns of the electromagnetic fields transmitted by the antennas. In this illustration, the intensity of the transmitted fields is represented in each direction by the distance between the center and the surface of the toroidal pattern in that direction. The dual toroidal transmission patterns, RP1 and RP1, present two transmission patterns with interchanged polarities, whereas the first transmission pattern RP1 illustrates the intensity of the component of the electric field E in the Θ direction of the polar coordinates and the second transmission pattern RP2 illustrates the intensity of the component of the magnetic field H in the Θ (which is equivalent to the intensity of the electric field in the ϕ direction of the polar coordinates). For clarity, the polar coordinate system PC is exemplified in the figure in a self explanatory manner in conjunction with the electric fields transmitted from an electric dipole antenna ADA in certain Θ & ϕ polar directions.

It should be noted here that the collinear arrangement of the antenna modules according to the invention, in which the antenna module is configured to transceive intensity patters having "null" poles/regions facing towards the other antenna(s), may provide suppression of about 30 dB in the EM coupling between the antennas. Specifically, such a decoupling between the antennas may be achieved by spacing the antenna modules 110 and 120 a distance of a few nominal wavelengths of the given wavelength band (e.g. 5 wavelengths apart) along the longitudinal Z axis such that each antenna is exposed to low/null gain transmission regions of the other antenna(s). Moreover, the use of dual antenna modules (e.g. providing substantially mutually orthogonal polarizations) may provide additional reduction/suppression to the EM coupling between the antennas 110 and 120 in at least some portions of the antennas' operational wavelength band. This, in turn, allows utilizing a wider effective wavelength band for transmission and/or reception of signals with high signal to noise due to low EM coupling/crosstalk between the antennas. For example the antenna modules 110 and 120 may be collinearly aligned with respect to one another with accuracy in the order of 3° to thereby reduce the EM coupling between them by an order of about 25 dB in some portions of the wavelength band.

Generally, the antenna modules 110 and 120 are associated with respective signal feeding modules 112 and 122 interconnecting the antennas with at least one transceiver 105 (transmitter(s) and/or receiver(s)) for electrically coupling signals to be transmitted and/or received by the antenna modules 110 and 120 with the transceiver 105. Typically, in such an antenna system, at least one of the feeding modules (e.g. module 122 in the present example) which feeds one of the antenna modules (e.g. 120) defines a transmission line that passes in/through the vicinity of at least one other antenna module (e.g. 110) at regions where the gain of its transmission pattern may affect noise to which the feeding modules 122 are exposed.

Indeed, in the conventional antenna designs, in which multiple antenna modules are used, the power of the noise induced on the feeding line may be relatively small compared to crosstalk noise between the antenna structures themselves, thus not baring significant deterioration to the SNR of the received and/or transmitted signals. However, in the present example, low cross talk between the antenna structures 112 and 122 is provided due to the collinear arrangement of the antennas with sufficient distance between them and with their "null"/low gain regions of their transmission patterns facing each other. Accordingly, in this case the induced noise affected on the feeding module 122 may significantly affect the SNR of the antenna system 100.

Therefore, according to some embodiments of the invention, in order to further improve the isolation between the antenna modules 110 and 120 and reduce the EM coupling and crosstalk between them, at least one feeding module 122, which is associated with one antenna 120 and whose transmission line passes near the second antenna 110, is configured and operable to provided balanced transmission to reduce the EM coupling between the antenna modules. Specifically, the feeding module 122 defines (includes or is associated with) a transmission line 123 and includes a induced current suppression utility 124 that is adapted for suppressing noise signals induced on the feeding module 122.

For example, according to some embodiments of the present invention, the transmission line 123 is formed by a shielded coaxial cable (transmission line) connectable to the antenna module 120 via a proper transformer (e.g. balun). The coaxial transmission line is an un-balanced transmission line whose outer conductive shield is generally exposed to interfering signals. Interfering noise signals, impeding the SNR of the transmission, may be induced on such un-balanced transmission line when it passes near the antenna module 110 (and/or near a transmission region thereof).

In embodiments of the invention where such an un-balanced transmission line is used, one or more quarter wave short circuit transformers (QWSC) 124 may be used being coupled to the transmission line 123 (e.g. accommodated thereon and coupled to the outer conductive shield of the coaxial line). Each of the QWSC transformers 124 is actually operating similarly to a parallel resonance circuit for reflecting back at least some of the noise induced on the un-balanced line (e.g. reflecting back noise induced on the conductive shield of the coaxial line) thereby improving the signal to noise ratio in the transmission line and improving the isolation between the antenna modules 110 and 120. Specifically, the QWSC transformers are typically adapted to cut off signals at the nominal frequency $\lambda$ propagating along certain parts of the un-balanced transmission line (e.g. propagating through the conductive shield of a coaxial cable). The cut off signals are generally reflected back through the cable 123.

Preferably, according to some embodiments of the invention, the elements of such induced current suppression utility, i.e. the QWSC transformers 124, are arranged along the transmission line 123 of the feeding module 122. Use of the multiple QWSC transformers 124 may provide for suppressing the EM coupling by an order of about 15 to 25 dB. For example, in the illustration of FIG. 1A, four such QWSC transformers 124 are accommodated on the transmission line 123 and each is adapted for reflecting noise signals induced on the transmission line 123. Each of the QWSC transformers contributes to the isolation between the antennas by cutting of certain fraction of the noise signals propagating in the transmission line 123 and thus together the four QWSC transformers 124 improve the isolation between the antennas by about 15 to 20 dB. It should however be understood that the invention is not limited to any specific number of such QWSC transformers, as well as is not limited to this specific example of the induced current suppression utility. The QWSC transformers 124 illustrated in FIG. 1A are formed for example by quarter wavelength conductive sections electrically connected to a conducting shield of the transmission line 123 (e.g. being a coaxial transmission line). According to some embodiments of the invention, the induced current suppression utility 124 includes one or more balanced transmission line sections and possibly one or more transformers, such as baluns, connecting the balanced transmission line sections with possibly un-balanced transmission sections of the transmission line 123. Preferably, for properly feeding a certain antenna (e.g. 122), the balanced transmission sections of the feeding module 122 are arranged in regions to which other antenna(s) may provide substantial gain (e.g. substantial EM radiation) to thereby reduce the intensity of induced noise on the feeding module 122. Specifically, the balanced transmission section of the line may be arranged to pass in the vicinity of other antenna modules of the antenna system 100.

In addition, according to some embodiments of the present invention, the transmission line 123 of the feeding module 122 of certain antenna 120 is configured to pass at regions where the other antennas have low gain. For example, as illustrated in the FIG. 1A, the transmission line 123 is arranged in the vicinity of the central axis of symmetry (Z axis) of the antenna module 110 where the gain of the antenna module 110 is relatively small due to the symmetry of the antenna 110. This further reduces the inductance of noise on a feeding module 122 of antenna 120 and by that improves the SNR of the antenna system 100 and reduces coupling between the antennas 110 and 120.

In embodiments of the present invention where additional improvement in the isolation between the antenna modules is required, the antenna system 100 includes an arrangement 140 of one or more parasitic antenna circuits (e.g. 140A) spatially arranged in regions where low gain of the antennas is thought, for dispersing and/or absorbing residual radiation in the regions. Actually, in an actual antenna system, at regions where low/null gain of the antennas is thought, various residual EM fields/radiation may exist and propagate for various reason such as finite sizes of the antenna elements, antenna feed structures, imperfect structures, positions and orientation of antenna elements etc'. Such a residual EM radiation may have substantial impact on the SNR of the antenna system 100 as it may induce stray signals (noise signals) on various elements of the system such as the feeding modules and antenna modules. By analyzing the structure of the antenna system and considering the wavelength band and nominal wavelengths at which the antenna structure should be operating, it is generally possible to a priori determine the pattern of the residual EM radiation in the vicinity of the antenna system 100. For example various algorithms (e.g. genetic algorithms) may be employed to predetermine the proper spatial arrangement and properties of the one or more parasitic antenna circuits (e.g. to determine the location(s) and the structure(s) of the parasitic antenna(s) as well as the load (impedance) connected their ports).

To this end, according to some embodiments of the present invention, one or more parasitic antenna circuits (e.g. 140A) are arranged in accordance with a predetermined pattern of the residual radiation associated with the antenna system 100 (or associated with specific module(s) of the system 100) to reduce the effects of such residual radiation. The one or more parasitic antenna circuits may be arranged in the vicinity of the antenna modules 110 and 120 for scattering at least some of residual EM radiation by which the antenna modules 110 and 120 are electromagnetically coupled, thereby reducing a crosstalk between said antennas.

Parasitic antenna circuits 140A may be configured and operable for resonating in frequencies corresponding to said wavelength band (i.e. at frequencies near λ) to thereby scatter and disperse the energy of residual radiation at that wavelengths existing in its vicinity. For example, the parasitic antenna circuit 140A may be configured as a resonance antenna in these wavelengths retransmitting and/or reflecting at least some portions of the residual radiation with a phase shift (e.g. of 180°) to cause destructive interference with other portions of the residual radiation and by that disperse the energy of the residual radiation. Alternatively or additionally, the parasitic antenna circuit 140A may be configured and operable to operate as loaded resonator at frequencies near λ to thereby absorb at least some portions of the residual radiation near its vicinity and possibly also to scatter some of that residual radiation. Utilizing such configured parasitic antenna circuits and arranging them at relevant locations around the antenna modules provide suppressing said residual EM radiation and by that further reducing a crosstalk between the antenna modules 110 and 120 by an order of about 5 dB.

Figure 1B:
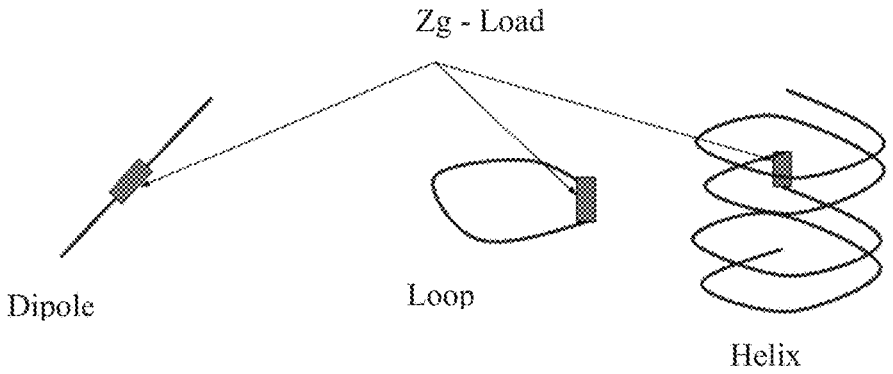
FIG. 1B illustrates schematically three examples of a parasitic antenna circuits which may be used in the antenna system of the invention for dissipating and/or scattering residual EM radiation.

Turning now to FIG. 1B there are illustrated schematically three types/structures of a parasitic antenna circuits which may be used in the antenna system 100 of the invention for dissipating and/or scattering residual EM radiation. Here, the three types of parasitic antenna circuits exemplified are: parasitic dipole antenna circuit with load Zg connected to the antenna's terminal, as well as parasitic loop antenna and parasitic helix antenna both associated with the same load Zg connected at their respective terminals. It should be noted here that according to the invention, other types and structures of parasitic antennas may also be used. The particular types used are generally selected in accordance with the directivity, polarization and efficiency to be obtained by the parasitic antennas for maximizing the isolation between the antenna modules (e.g. 110 and 120) of the antenna system 100.

The parasitic antennas illustrated here are terminated with a load Zg (impedance) which may be selected anywhere on the impedance span (e.g. short, open, real only, imaginary only, capacitive, inductive, tuned parallel circuit, tuned series circuit or any combination thereof). In accordance with the selection of the load the energy dissipation of the parasitic antenna and the phase shift affected on EM radiation reflected thereby may be tuned. This allows adjusting the selected parasitic antennas such as to improve the energy absorbance and interference with EM radiation provided by the parasitic antennas.

Figure 1C:
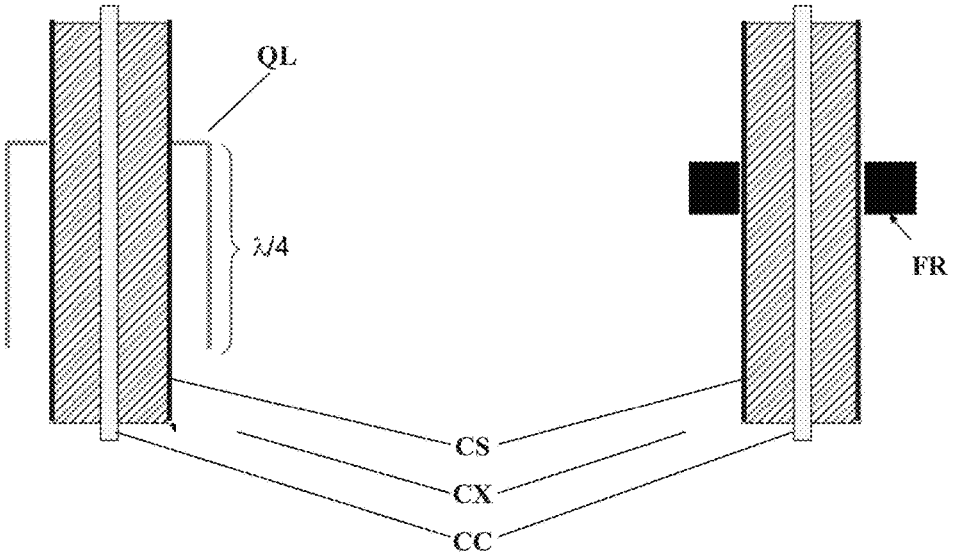
FIG. 1C illustrates schematically two examples of induced current suppression elements which may be included in the induced current suppression utility according to some embodiments of the invention.

FIG. 1C illustrates schematically two examples of induced current suppression elements QL and FR which may be included in the induced current suppression utility 124 of system 100 (e.g. associated with the feeding module CX). Here, a transmission line CC is illustrated associated with a conductive shield CS. The transmission line CC may be for example a balanced transmission line enclosed by the conductive shield CS. Alternatively, transmission line CC may be an un balanced transmission line. For example the transmission line CC and the conductive shield CS may be formed as parts of a coaxial cable.

Induced currents over a transmission can be effectively reduced by creation of high impedance section in the current route. As illustrated in the figure, such high impedance can be implemented by quarter wavelength short circuit transmission line sections (transformers) QL, ferrite ring FR, and/or by inductive loading by merely coiling of the transmission line CC (not shown). In one example in the figure, a cross-section of the feeding module CX is illustrated with the quarter wavelength short circuit transformers QL connected to the conductive shield CS. The short circuit transformers are formed with a cup like structure with side walls length being about quarter wavelength of the operative wavelengths to be transmitted through the feeding module CX. In another example, the cross-section of a ferrite ring FR surrounding the conductive shield CS and electrically connected thereto is illustrated. Reference is now made to FIGS. 2A to 2J in which the structure and operation of a conventional dipole antenna module is illustrated schematically. FIG. 2A is an exploded view of a conventional half wave electric dipole antenna DA. Such an electric dipole antenna and a corresponding magnetic dipole antenna (e.g. slot antenna) having similar but dual properties may be utilized in antenna system 100 of the invention in the manner described above with reference to FIG. 1A.

In the following, with reference to FIGS. 2B to 2J, there is provided a brief analysis of the reception and transmission properties of such an electric dipole antenna DA operative as a resonant half wavelength dipole at a frequency band around a nominal frequency of 2760 MHz (nominal wavelength λ of about 11 cm). The antenna DA is located at the origin of a Cartesian coordinate system with its longitudinal axis oriented along the Z-axis of the coordinate system. It should be noted that the following analysis may also be applied to the operation of a magnetic dipole antenna which may be configured to operate at similar wavelengths to provide a "dual" transmission pattern with polarization orthogonal to that of the electric dipole antenna.

A dipole antenna may be operating as a transmitter for converting an electric voltage applied to its terminals into an electromagnetic radiation, or vice versa as a receiver. A dipole antenna is generally operating as a directional antenna with an improved gain of about 2.1 dB near the equator (i.e. near θ=90°) and reduced gain near the poles (i.e. near θ=0°/180°).

Figure 2B:
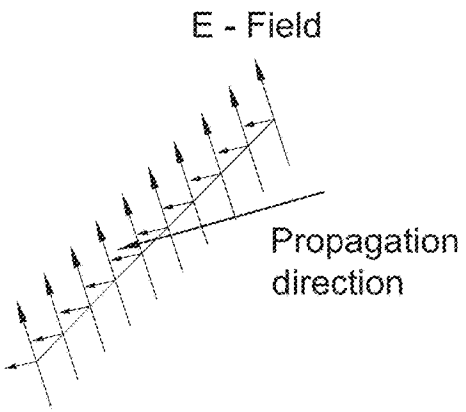
FIGS. 2A to 2J are schematic illustrations demonstrating the structure and operation of a conventional dipole antenna module.
Figure 2A:
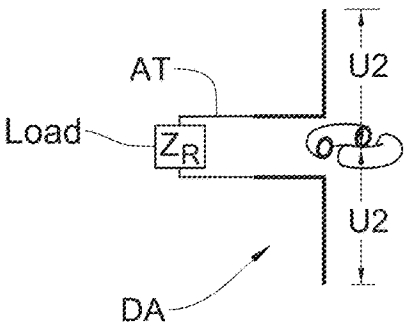
Figure 2A:
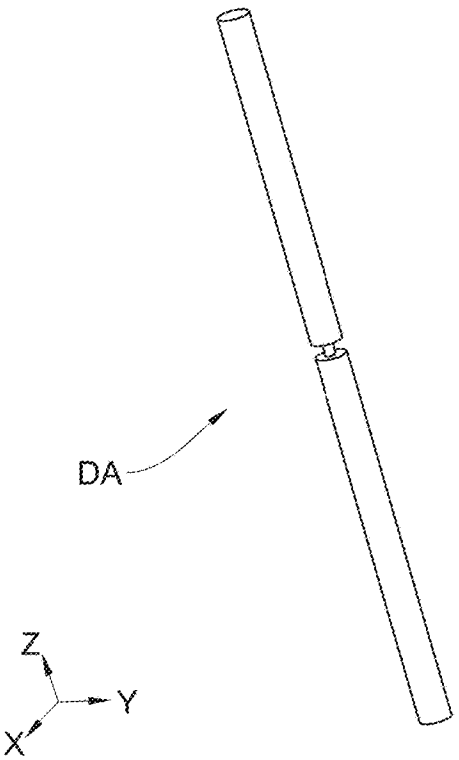

A receiving operational mode of the dipole antenna DA, during which it transfers the electromagnetic field E in its vicinity into voltage over the antenna's terminal AT, is illustrated schematically in FIG. 2B. The magnitude of the received voltage in the antenna terminal AT depends on the direction of the propagating wave front, the alignment between the polarization of the antenna and the polarization of the propagating wavefront, and on the impedance relation between antenna impedance and load impedance $Z_r$. Therefore, for dipole antenna DA, the antenna gain $G(\theta,\phi)_{dB}$, which is indicative of the magnitude and phase of the voltage signal, $V_{oc}$, on its terminals, is generally dependent on the orientation θ, ϕ at which the planar wave approaches the antenna and the polarization of the planar wave.

Figure 2C:
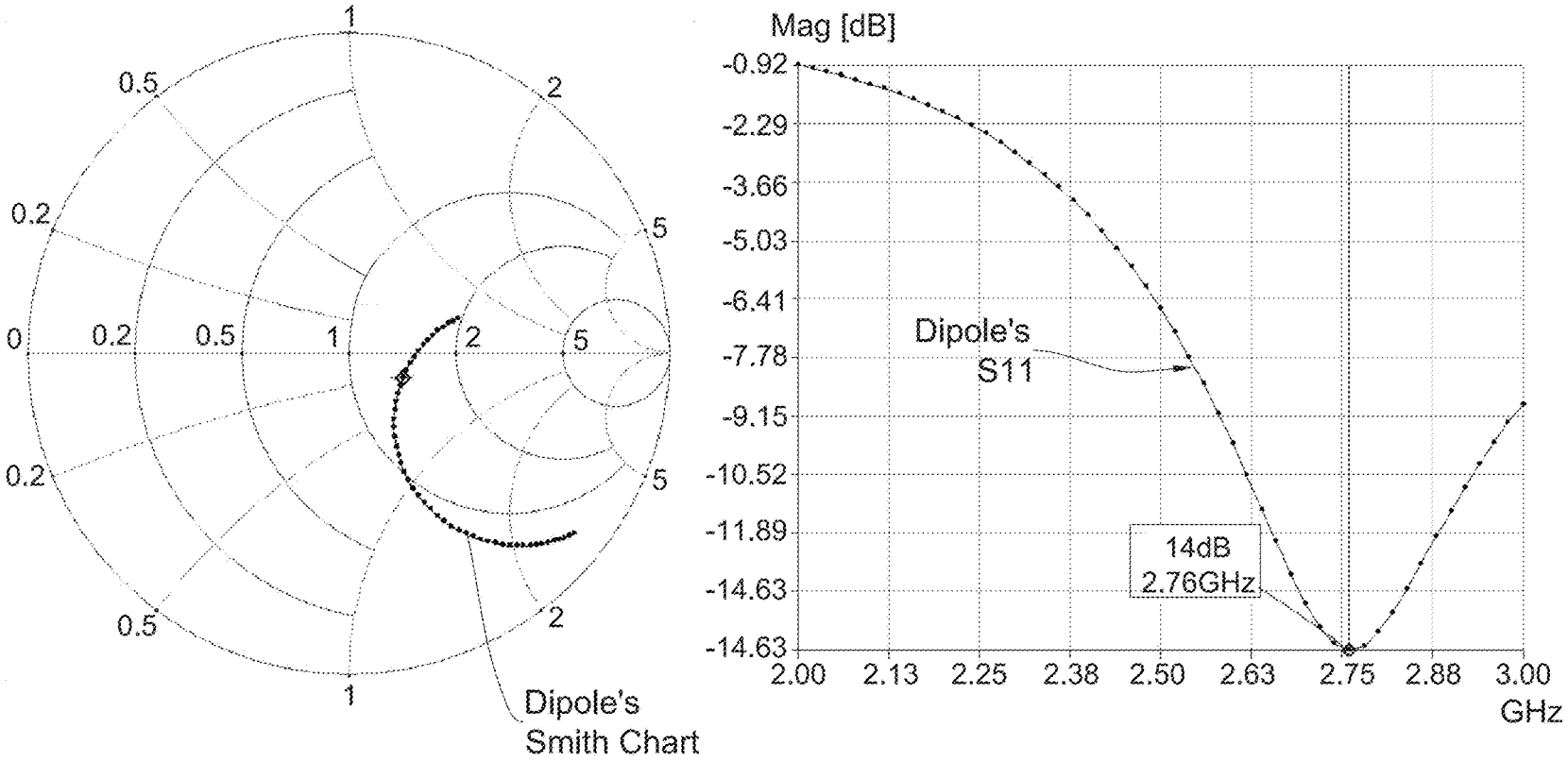

A dipole S11 graph illustrating the transmission efficiency of the dipole antenna DE in dB is illustrated for example in FIG. 2C. Assuming there are no lossy elements within the antenna construction, a dipole antenna DA is generally very efficient in its ability to transfer input voltage to radiation (in a transmitting mode) and radiation into voltage (in a receiving mode). For the dipole antenna DA, the impedance characteristics provide that 99.8% of the energy is being transformed when transmitting and/or receiving radiation at wavelengths near 2760 MHz. This makes the dipole antenna very efficient in converting electric power to radiation and vice versa. For example, considering equation (2) above, with the peak voltage of 1V and impedance of Z=68−j10.59Ω the overall transmitted power is 7.136 mW. Additionally provided in FIG. 2C is a Dipole's Smith Chart.

Figure 2D:
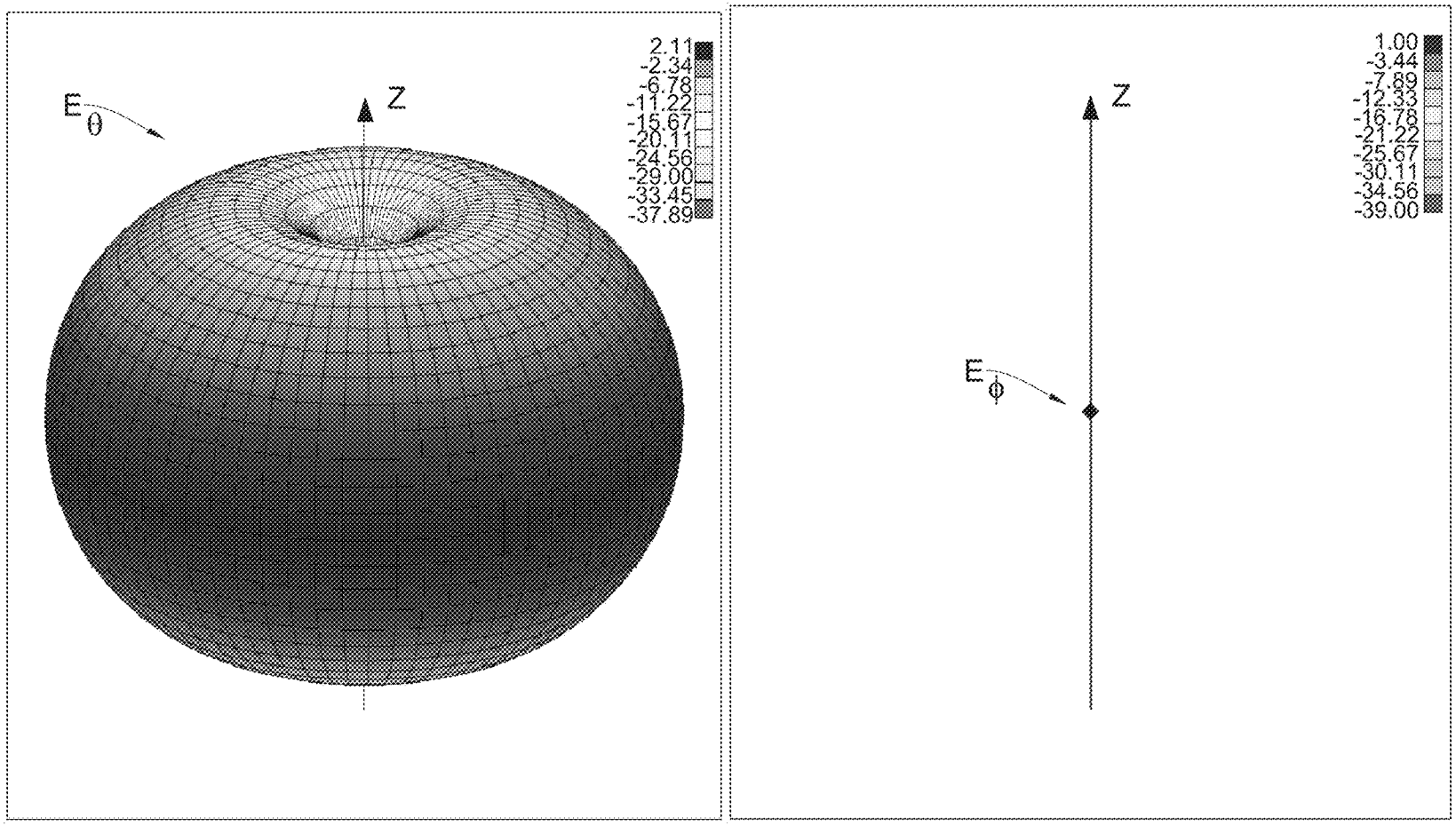
Figure 2E:
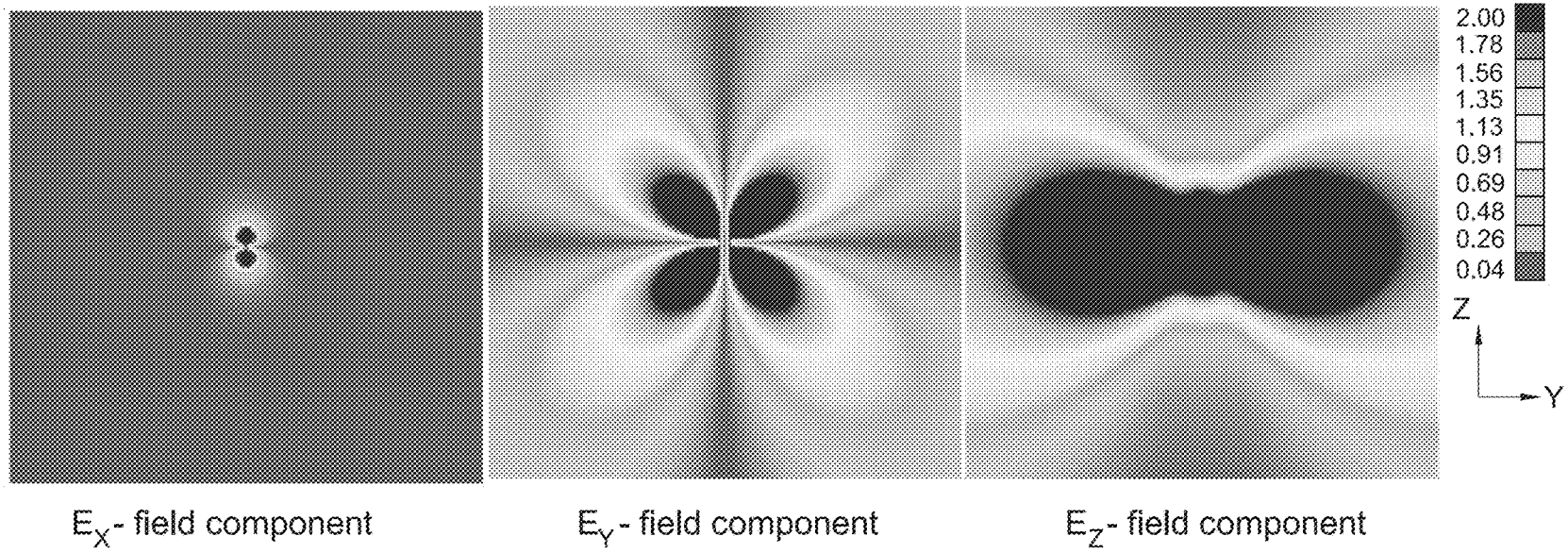

The far field radiation pattern $G(\theta,\phi)_{dB}$ of an electric dipole, such as antenna DA, is illustrated in FIG. 2D. The electric field pattern of the antenna is characterized with θ-polarized radiation pattern wherein the θ-component of the field $E_\theta$ (in polar coordinates) dominates and the ϕ-component $E_\phi$ is negligible. This far field behavior of the radiation pattern is asymptotically approached as the distance from the source grows towards infinite. In the boresight direction(s) (main beam direction at θ=~90°, the far field radiation-pattern $G(\theta,\phi)_{dB}$ may be used to estimate the actual power density obtained at a distance of several wavelengths from the antenna with insignificant errors. However, for the endfire direction (null direction of the beam at θ=~0°/180°), fields, which completely vanish at the far field (∞), still exist (although small) at finite distances. Therefore, for the endfire direction specific near field calculations should be employed in order to determine the radiated field at finite distances from the source.

A near field analysis of the radiation pattern of a half wave electric dipole antenna DA is illustrated in FIG. 2D. Here, three intensity diagrams $E_X$, $E_Y$ and $E_Z$ are provided corresponding to three Cartesian components X, Y, Z of the electric field radiated by the antenna DA at a 1×1 $m^2$ surface area which is centered at the origin and perpendicular to the X axis. In the near field, the electric fields in the endfire direction (null directions along the Z axis) do not vanish completely but rather decrease to low values of approximately 30 dB below the field intensity at the same distance along the main beam.

Figure 2F:
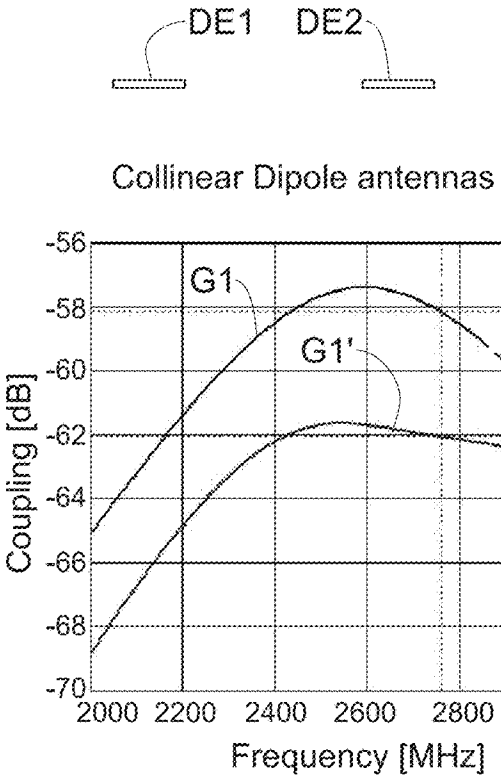
Figure 2G:
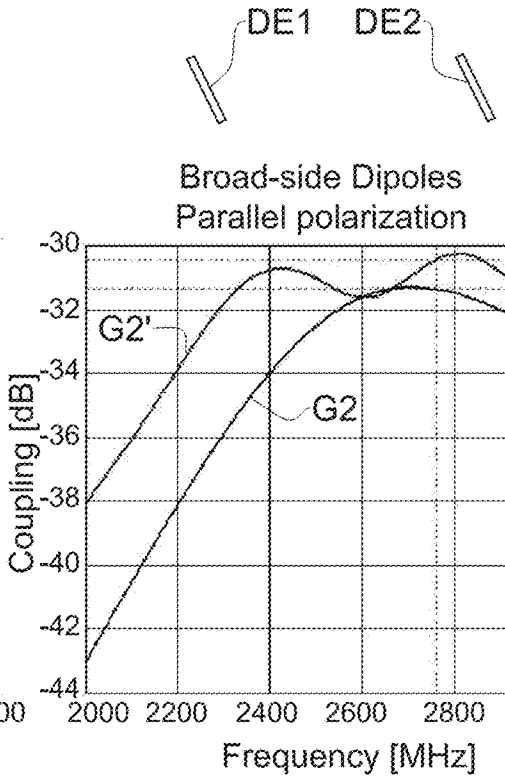
Figure 2H:
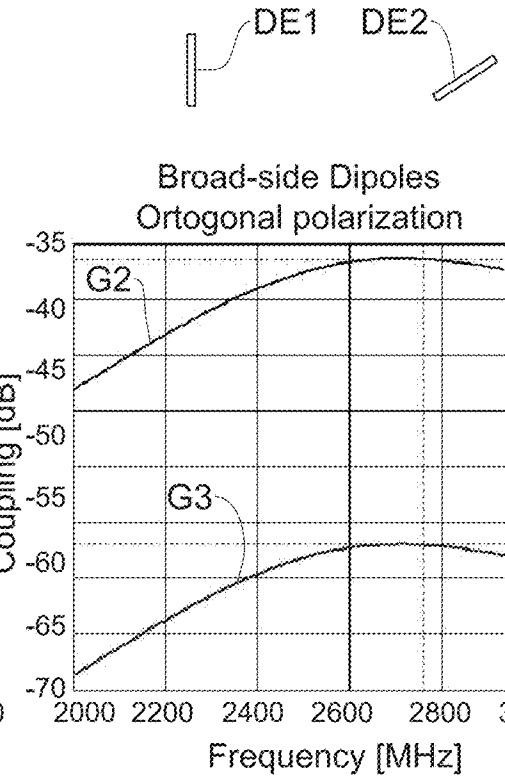

In FIGS. 2F-2H, the various arrangements of a pair of dipole antennas DE1 and DE2 are illustrated together with respective graphs G1 to G3 and G1' to G2' which are indicative of the EM coupling between the pairs of antennas in synthetic case without considering the effects of the feeding structures. As noted above, a resonant dipole has a 'donut' shaped pattern as illustrated schematically in FIG. 2C where a null is directed towards the dipole's axis. The graphs G1 to G3 are indicative of the EM coupling between the antennas as obtained utilizing accurate simulations based on the MoM technique. The graphs G1' and G2 are indicative of the EM coupling between the antennas as obtained utilizing simulations based on a simplified model of the dipole antennas.

Pair of dipole antennas DE1 and DE2 arranged and oriented collinearly parallel to the Z axis are illustrated in FIG. 2F. The EM coupling between those antennas is theoretically mainly due to the Z component of the electric field $E_Z$ radiated by one antenna which causes current distribution over the other antenna and thus affects port (input/output) voltage thereon. FIG. 2F also illustrates a graph G1 of near field analysis of the theoretical coupling between a pair of such collinearly arranged dipole antennas spaced apart by about five wavelengths (e.g. spaced by about 0.5 meters). The EM coupling between the antennas near the nominal frequency of 2760 MHz is theoretically suppressed by 58 dB. The near field analysis here and in FIGS. 2F and 3G described below was carried out by Method of Moments (MoM) theory at nominal frequency of ~2800 MHz.

While on the collinear arrangement, illustrated in FIG. 2F, the dipoles observe each other through their nulls (endfire directions), a full gain of the dipoles is experienced in a broad side arrangement of the dipoles. For comparison, FIGS. 2G and 2H respectively illustrate parallel and orthogonal broad-side arrangements of a pair of antennas DE1 and DE2 similar to those of FIG. 2F. The dipole antennas are arranged spaced apart by a distance of 0.5 m aside from one another, where in FIGS. 2G and 2H the dipoles respectively have parallel and orthogonal polarizations. A near field analysis of the theoretical coupling in each of the parallel and orthogonal broad-side arrangements of the antennas is illustrated by graphs G2 and G3 respectively. These graphs G2 and G3 show that coupling between the antennas is theoretically suppressed by only about 30 dB near the nominal frequency of 2760 MHz, e.g. the Z component of an electric field radiated by one antenna is reduced by 30 DB when arriving to the other antenna in the broad side arrangement.

Theoretically, polarization orthogonality assures ideal coupling (since there is no meaningful projection of one antenna field on the other). Nevertheless, pure orthogonality doesn't exist. Under careful construction, elements with polarization purity of 25 dB may be realized (i.e. ~3° deviation from 90° of the polarization vectors of the antennas); in this case extra reduction of 25 dB in coupling can be obtained.

In view of the above, EM-coupling/crosstalk between the two collinear dipole antennas with orthogonal polarizations such as those illustrated in the antenna system 100 of FIG. 1A may theoretically be reduced by about 85 dB. The individual contributions of each of the above parameters to decoupling between the antennas are described in the following table:

| Parameter | | Remarks |
|---|---|---|
| Distance (5λ) | ~30 dB | |
| Arrangement | ~30 dB | Collinear installation |
| Polarization | ~25 dB | Orthogonal orientation |

Figure 2J:
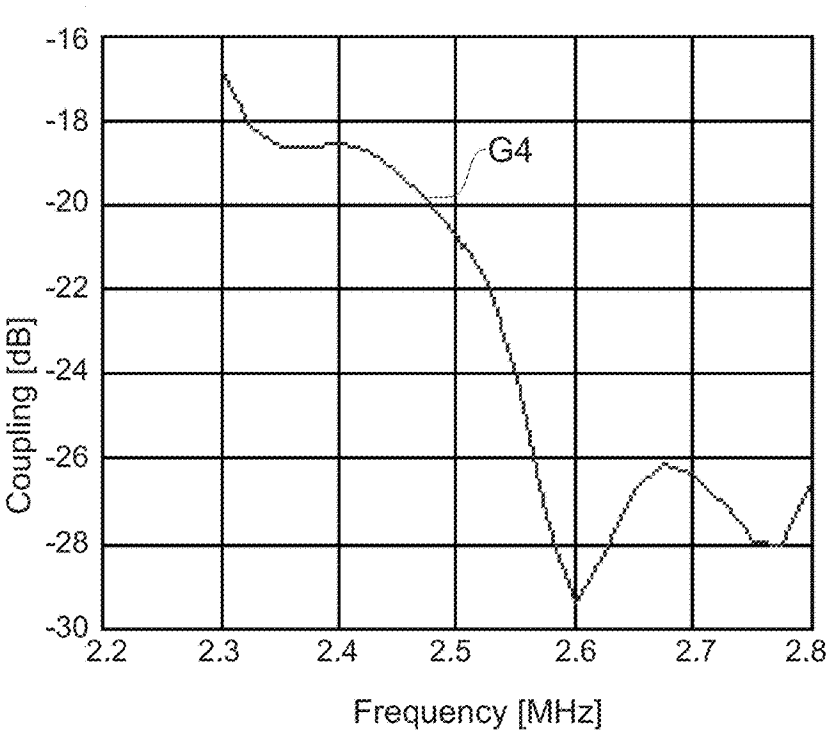
Figure 2I:
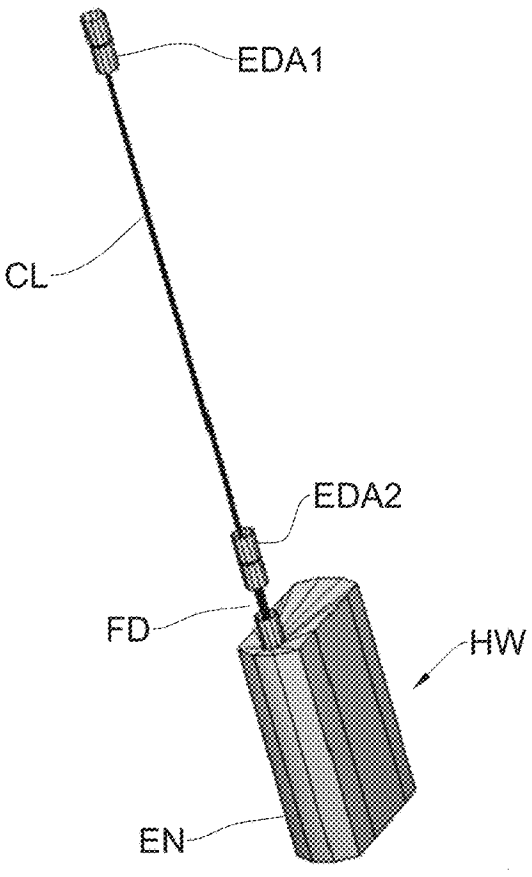

Indeed, combination of all three factors (distance (e.g. of 5λcollinear arrangement, orthogonal polarization) may theoretically provide an overall de-coupling of about 85 dB. Nonetheless, such ideal de-coupling cannot be practically realized due to implementation issues such as feeding circuitry, mechanical installation and manufacturing tolerances. FIG. 2I illustrates a practical implementation of a collinear installation of a pair of electric dipole antennas EDA1 and EDA2 including feeding arrangement for the two antennas FD and metallic enclosure EN for hardware (receiver and/or transmitter connected to the antennas). Here, the feeding arrangement, which is connecting the antennas to the receiving/transmitting hardware HW, includes a coaxial cable CL with constructed balun for each dipole antenna. FIG. 2J shows a graph G4 demonstrating the actual coupling between two such collinearly aligned antennas. The graph G4 was calculated utilizing the MoM technique to obtain accurate results. Graph G4 illustrates that for actual implementation, very poor de-coupling between the antennas is obtained in the order of 28 dB. These poor results are at least in part due to surface currents over the coaxial transmission line CL connecting the upper dipole antenna to the metallic hardware enclosure of the transceiver hardware HW.

Reference is now made to FIGS. 3A to 3D illustrating schematically a specific embodiment of an antenna system 100 according to the present invention. For clarity, reference numbers similar to those of FIG. 1A are used herein to indicate elements having similar functionality.

Figure 3A:
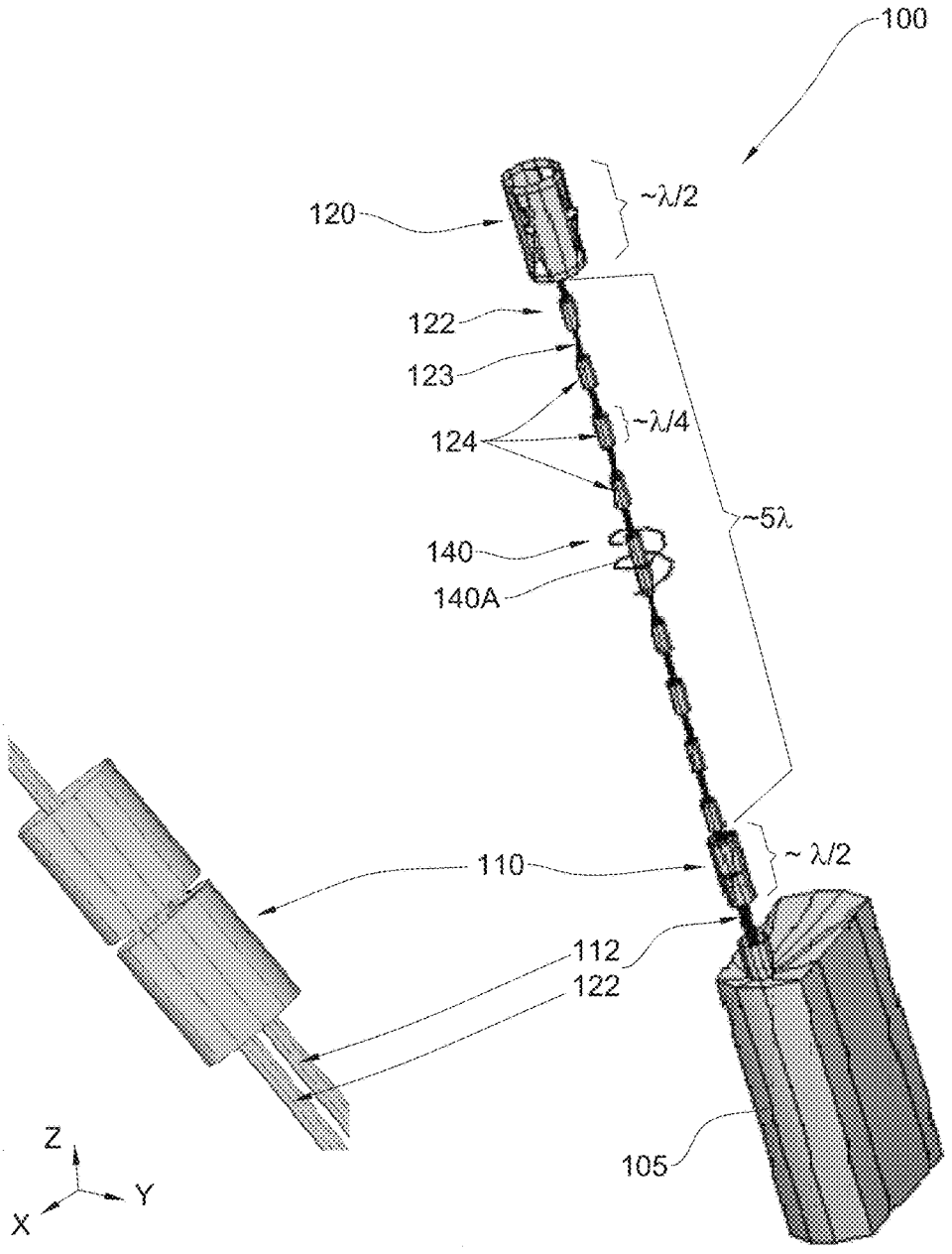
FIG. 3A illustrates schematically an embodiment of an antenna system 100 according to the present invention.

The antenna system 100 in the embodiment of FIG. 3A includes two antenna modules, 110 and 120, which are configured and operable for transmitting and/or receiving EM radiation at a common wavelength band around a nominal wavelength λ of 10.9 cm (corresponding to a nominal frequency 2760 MHz). The width of the frequency band for which high isolation of about 45-50 dB between the antennas is provided is in the order of 200 MHz to 300 MHz. The two antenna modules, 110 and 120 are collinearly arranged along a common longitudinal axis Z with a distance of a few (e.g. five) nominal wavelengths therebetween (e.g. about half a meter apart). Also, the antenna modules, 110 and 120, are respectively an electric-dipole antenna and a magnetic-dipole antenna. The antennas are thus configured to provide low antenna-gain at their endfire directions (along their common longitudinal axis Z), while also configured and operable for transmitting and/or receiving EM radiation of substantially mutually orthogonal polarizations respectively. The distance between the antennas 110 and 120 along the Z axis, their doughnut-shape transmission patterns and their mutually orthogonal polarizations provide reduction in the EM coupling between antenna modules in the common wavelength band at which the antennas are configured to transmit and/or receive.

The antenna modules 110 and 120 are associated with respective transmission feeding modules 112 and 122 interconnecting the antennas with two respective transceivers 105 which are enclosed by metallic housing HS. The transmission feeding module 122, which interconnects the antenna 120 with its respective transceiver, is passing through the antenna 110 near the axis of symmetry (Z) thereof where it has low transmission gain. In order to further improve the isolation between the antennas 110 and 120, feeding module 122, which passes near antenna 110, includes/defines a transmission line 123 and includes an induced current suppression utility 124. In this particular non-limiting example, the transmission line 123 includes a shielded coaxial cable and a balun connecting the cable to the antenna 120. Additionally, in this example the induced current suppression utility 124 includes several QWSC transformers which are coupled to the outer shield of the coaxial cable of the transmission line 123. The QWSC transformers 124 are configured and operable for reflecting back at least some of the noise signals near the nominal wavelength λ induced on the conductive shield of the coaxial cable when it passes near the antenna 110.

In addition, in the present embodiment, the antenna system 100 includes a parasitic antenna circuit 140A that is located in the vicinity of the coaxial cable of the transmission line 123 at a region between the antennas 110 and 120. The parasitic antenna circuit includes in this example a loaded resonance circuit (i.e. energy dissipating resonance circuit; e.g. resistive circuit) that is connected to, or integrated with, a parasitic antenna located near the coaxial cable 123. The parasitic antenna circuit 140A is configured and operable for resonating at frequencies near the nominal frequency of the antenna 110 (e.g. resonating in response to radiation with nominal wavelength λ) and thereby dissipate, as heat, at least some of the energy of residual radiation appearing in the vicinity of the parasitic antenna in wavelengths near the nominal wavelength. For example, the parasitic antenna may dissipate residual energy which may be associated with surface currents on the shield of the coaxial cable 123. Additionally, since the parasitic antenna circuit 140A is configured for resonating in frequencies corresponding to the wavelengths near λ, it thus also operates to scatter and disperse certain portions of the residual energy. Particularly, in the present example, the parasitic antenna circuit 140A is specifically designed to reflect/scatted certain portions of the residual radiation with a phase shift (e.g. of180°) and by that affect an interference with non scattered parts of the residual radiation thus reducing the overall intensity of the residual radiation and of residual surface currents (noise) induced on the shield of the coaxial cable 123.

Thus, the present invention provides reduction in the EM coupling of the antennas 110 and 120 to about 45 to 50 dB. This is achieved by utilizing the above described techniques including: collinear arrangement and mutually orthogonal polarizations of the antennas 110 and 120, and in some embodiments also by utilizing the induced current suppression utility 124 (QWSC transformers) and the arrangement 140 of parasitic antenna circuit 140A. In the following, with reference to FIGS. 3B to 3D, the effect of the invention on the EM coupling between the antennas is described in more details.

Figure 3B:
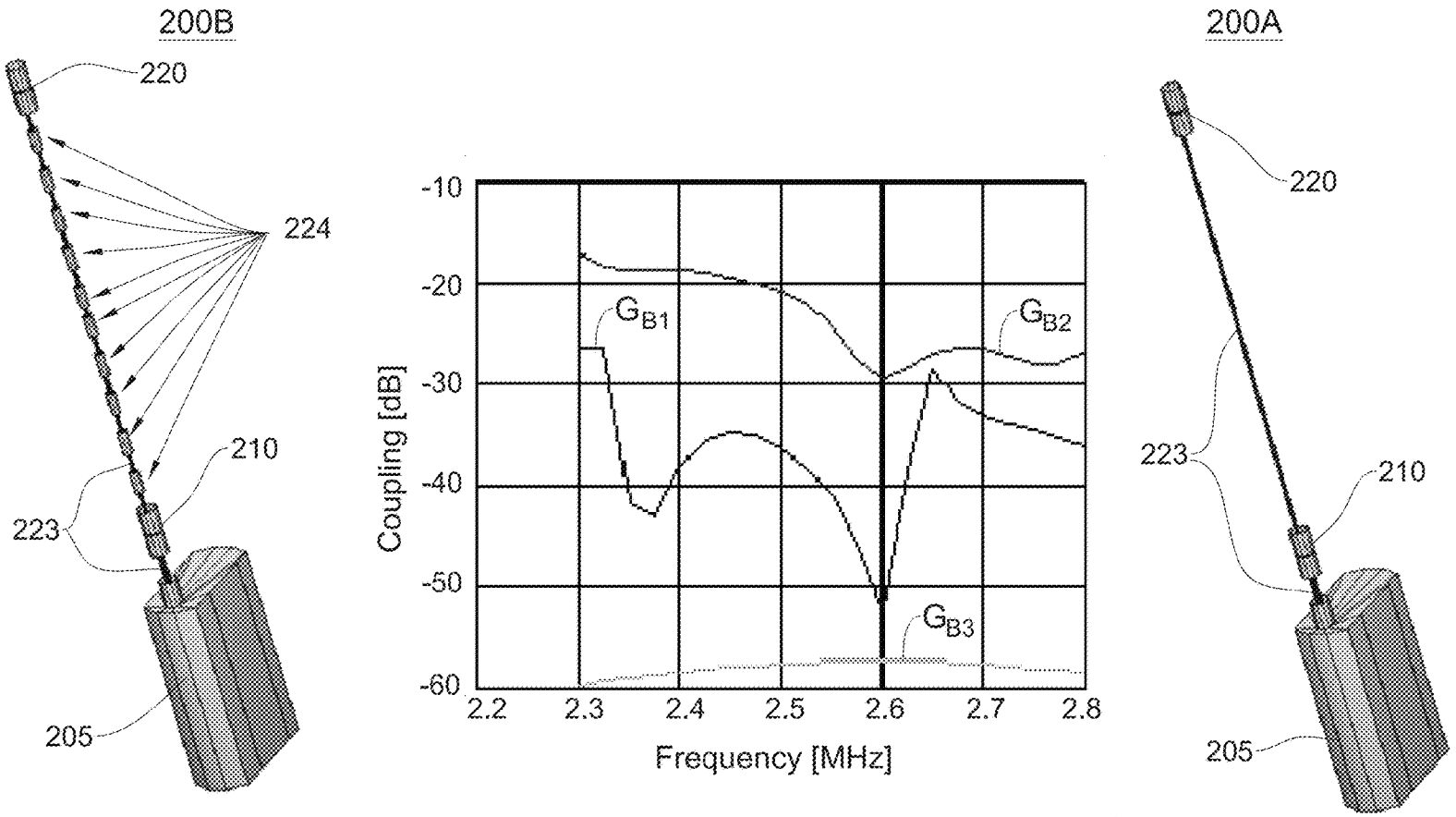

FIG. 3B shows two illustrations of general antenna systems, 200A and 200B, each including a collinear antenna arrangement including two electric dipole antennas 210 and 220 which have substantially parallel polarizations, and are distanced by about five wavelengths from one another. Additionally, antenna system 200A includes the above-described induced current suppression utility 224 of the invention. Each of the antenna systems 200A and 200B includes a feeding module including a coaxial cable (transmission line) 223 which connects antenna 220 to the transceiver 205 and passes near the center of antenna 210. The induced current suppression utility 224 includes several QWSC transformers (λ/4 sections) 224 accommodated along the transmission line 223 in the manner described above.

FIG. 3B shows a graphical illustration of the EM coupling between the antennas 210 and 220 in each of the antenna systems 200A and 200B. Specifically, graph $G_{B1}$ corresponds to the EM coupling in the system 200B in which the QWSC transformers (λ/4 sections) 224 are accommodated along the transmission line 223. Graph $G_{B2}$ corresponds to the EM coupling in the system 200A in which induced current suppression utility is not employed. Graph $G_{B3}$ illustrates the theoretical EM coupling between two such collinear antennas in case of an ideal construction with pure collinear arrangement and without considering the effects of the feeding/transmission line(s). Graphs $G_{B1}$, $G_{B2}$ and $G_{B3}$ are calculated utilizing the MoM technique to respectively accurately estimate the coupling between the antennas in each of the systems 200B, 200A and in an ideal pure collinear arrangement without feeding. In this regards, the addition of the induced current suppression utility 224 (λ/4 traps) across the transmission line 223 of the antenna systems 200B improves (reduces) the achieved coupling between the antennas, although the theoretical values aren't exceeded. Specifically, for certain wavelengths (e.g. for frequency of about 2.6 GHz) an improvement of about 20 dB is obtained in the isolation between the antennas 210 and 220.

FIG. 3C shows an antenna system 200C configured and operable in accordance with the present invention. The antenna system 200C is substantially similar to the antenna system 200B of FIG. 3B except for that in system 200C the electric dipole antenna 220 of system 200B is replaced by a magnetic dipole antenna 220S (slot antenna) and this magnetic dipole antenna 220S is arranged collinearly with the electric dipole antenna 210 at a distance of about five wavelengths therefrom. This provides that the electric dipole antenna 210 and the magnetic dipole antenna 220S are associated with mutually orthogonal polarizations. By this, the EM coupling between the antennas is further reduced within the desired wavelength band.

Indeed, in theory, orthogonal polarization between the antennas should result with low vanishing EM. However, as noted above, since the antennas are not infinitely spaced from one another and their radiation pattern in the endfire direction is not entirely vanished (as evident for example from FIG. 2D), when the antennas are orthogonally polarized there is some EM coupling between them. In practice, a reduction of about 25 dB in the EM coupling between the antennas may be obtained by utilizing the orthogonally polarized antenna arrangement, as illustrated, assuming deviation of about ~3° from a pure orthogonal case.

FIG. 3C includes a graphical illustration $G_{B4}$ indicating the coupling between the electric dipole 210 and the magnetic dipole 220S antennas of system 200C. Additionally, for comparison, the figure also includes the graph $G_{B1}$ corresponding to the coupling between the electric dipole antennas 210 and 220 of system 200B. From comparing the graphs $G_{B1}$ and $G_{B4}$ it is evident that transposing the polarization of one of the antennas may provide an improvement of about 20 to 25 dB in the isolation between the antennas for certain regions of the frequency/wavelength band. In addition, in many cases, it may be desired to attain a wide effective frequency/wavelength band at which transmission and/or reception may be obtained with high isolation between the antennas. Widening the effective band at which the antennas are isolated may be achieved according to the invention by utilizing dipole antennas having transposed/orthogonal polarizations. For example, in case where an isolation of at least 45 dB between the antennas is desired/required, the antenna system 200B would provide an effective frequency band ranging between 2.57 to 2.61 GHz while for the same isolation condition the antenna system 200C provides an effective frequency band more than twice as wide ranging in about 2.53 to 2.64 GHz. Thus, one of the main contributions obtained by using antennas of orthogonal polarizations of their radiation patterns is to the bandwidth in which the isolation exceeds a certain value.

FIG. 3D illustrates an antenna system 200D configured and operable in accordance with the present invention. The antenna system 200D is similar to the antenna system 100 of FIG. 3A. The antenna system 200D is also substantially similar to the antenna system 200C of FIG. 3C except for that system 200D includes an additional arrangement 140 of parasitic antenna circuits which in this particular example includes one parasitic antenna circuit 140A. The parasitic antenna circuit 140A is located along the transmission line 223, between the two antennas 210 and 220S. The transmission line 223 includes a coaxial cable feeding the antenna 220S. The parasitic antenna circuit 140A is adapted to absorb (dissipate) and to scatter (reflect) certain portions of that residual energy/energy which is associated with currents (noise) induced on the transmission line 223 along its passage near the antenna 210.

Accordingly, at least some portions of the energy transferred between the antenna elements 210 and 220S may be subjected to controlled scattering and absorbing by parasitic antenna circuit 140A, being a resonance element, located between them. When the parasitic antenna circuit 140A is impinged by the energy related to the residual coupling mechanism between the antennas 210 and 220S, part of this residual energy is scattered while the other parts may be absorbed and dissipated by a load (e.g. resistor) integrated/connected to the parasitic antenna circuit 140A. Here in the present example, the load and the resonance of the parasitic antenna circuit 140A are pre-tuned to control the phase of the scattered energy such that it is out of phase with respect to the original residual energy by which the antennas 210 and 220S are EM coupled. This allows for reducing the residual energy which couples the antennas and thus improving the isolation between the antennas.

In the present example, the parasitic antenna circuit 240A includes a loaded resonating circuit including a loaded element (helix) located near the transmission line 223 (e.g. surrounding the transmission line 223) and adapted to absorb and scatter residual EM radiation emitted from the line 223.

FIG. 3D includes a graphical illustration $G_{B5}$ indicating the coupling between the electric dipole 210 and the magnetic dipole 220S antennas of system 200D as obtained when utilizing several QWSC transformers (λ/4 sections) 224 as well as the parasitic antenna circuit 240A which is arranged along the coaxial transmission line 223 in between the antennas 210 and 220S. Also illustrated here for comparison are the graphs $G_{B1}$ and $G_{B4}$ which respectively illustrate the EM coupling between two electric dipole antennas 210 and 220 (system 200B) and the EM coupling between electric and magnetic dipole antennas 210 and 220S (system 200C) where the same number of QWSC transformers (λ/4 sections) 224 are used. From comparing the graphs $G_{B5}$ and $G_{B4}$ it is evident that utilizing such an arrangement 240 of the parasitic resonant antenna circuit 240A, located in between the antennas, further improves the isolation between the antennas and widens the effective wavelength band which can be used under a certain desired isolation conditions. Specifically, as evident from graph $G_{B5}$, for desired 45 dB isolation between the antennas, the use of the parasitic resonant antenna circuit 240A provides an effective frequency/wavelength band ranging between about 2.48 to 2.75 GHz. For desired 48 dB isolation between the antennas, the use of the parasitic resonant antenna circuit 240A provides an effective frequency/wavelength band ranging between about 2.49 to 2.72 GHz. Thus, the use of this mechanism provides better isolation between the antennas as well as widening of the effective wavelength band at which the antennas are isolated. To this end, the invention provides for reducing the EM coupling between two adjacent antenna modules by 45 dB over a frequency band of width about 10% of a nominal (operative) frequency the antennas. In cases the parasitic antenna elements are not used the frequency band width of about 5% of a nominal (operative) frequency is provided for which 45 dB suppression in the EM coupling is achieved.

The invention claimed is:

1. An antenna system operative for simultaneous transmission and reception in a certain frequency band of electromagnetic (EM) radiation, the antenna system comprising at least two antenna modules operative in said certain frequency band, wherein:

said at least two antenna modules are collinearly arranged along a common axis;

the at least two antenna modules comprise omni-directional antennas of at least two different types, arranged in an alternating fashion along the same axis thereby providing wide azimuthal coverage; wherein each two locally adjacent antenna modules of said at least two antenna modules of the different types are configured as follows:

the two locally adjacent antenna modules are spaced apart from one another along said axis by a distance of few nominal wavelengths of said frequency band associated with a zone of near field coupling between the antenna elements; said distance thereby providing small dimensions of the antenna system;

the two locally adjacent antenna modules comprise the antennas of two different types comprising a magnetic dipole (MD) antenna module and an electric dipole (ED) antenna module configured to operate at said nominal wavelength of said certain frequency band and characterized by substantially mutually orthogonal polarizations of radiation and by respective toroidal EM radiation patterns coaxial with respect to said common axis providing the low gain along said axis, thereby suppressing the near field EM coupling between the antenna modules in said common frequency band.

2. The antenna system of claim 1 comprising at least one signal feeding module associated with at least one of said at least two antenna modules, the signal feeding module defining a transmission line passing through the vicinity of at least one other of said at least two antenna modules, said feeding module comprising a induced current suppression utility adapted for suppressing noise signals induced on said feeding module by said at least one other antenna module, thereby reducing the EM coupling between said at least two antenna modules.

3. The antenna system of claim 2, wherein said induced current suppression utility comprises one or more quarter wave short circuit transformers adapted for reflecting noise signals to which said feeding module is exposed.

4. The antenna system of claim 3, wherein said one or more quarter wave short circuit transformers comprise one or more quarter wavelength conductive sections electrically connected to a conducting shield associated with said transmission line.

5. The antenna system of claim 2, wherein said transmission line defined by said feeding module passes near a central symmetry axis of said at least one other antenna module, thereby reducing the noise signals induced on said feeding module by at least said one other antenna module.

6. The antenna system of claim 1, comprising an arrangement of one or more parasitic antenna circuits configured and operable for resonating in frequencies corresponding to said frequency band; said one or more parasitic antenna circuits being arranged in the vicinity of said at least two antenna modules for scattering at least some of a residual EM radiation by which said antenna modules are electromagnetically coupled thereby reducing a crosstalk between said antenna modules.

7. The antenna system of claim 6, wherein said one or more parasitic antenna circuits comprise at least one loaded resonance circuit configured and operable for absorbing at least some of said residual EM radiation.

8. The antenna system of claim 6, wherein said arrangement of one or more parasitic antenna circuits is configured and operable for shifting phase of at least a part of the residual EM radiation to cause destructive interference with other parts of said residual EM radiation thereby suppressing said residual EM radiation arid reducing a crosstalk between said at least two antenna modules.

9. The antenna system of claim 1, wherein said distance between the antenna modules corresponds to at most five nominal wavelengths.

10. The antenna system of claim 1, characterized by one or more of the following:

a) said at least two antenna modules are configured for providing substantially mutually orthogonal polarizations with accuracy in the order of 3° such that an EM coupling between said antenna modules is reduced by an order of about 25 dB in at least some portions of said frequency band thereby widening the effective frequency band having low EM coupling between said at least two antenna modules;

b) an EM coupling between said at least two antenna modules is below 45 dB over the frequency band of about 10% of a nominal frequency of said frequency band.

11. The antenna system of claim 2, wherein said induced current suppression utility is configured and operable for reducing coupling between said antennal modules by about 15 dB.

12. The antenna system of claim 6, wherein said arrangement of one or more parasitic antenna circuits is configured for dispersing and/or absorbing at least some of the residual EM radiation, to thereby suppress the EM coupling between said at least two antenna modules by about 5 dB.

13. An antenna system comprising:

at least two antenna modules of at least two different types, arranged in an alternating fashion along a common axis; said at least two antenna modules comprising two locally adjacent magnetic dipole (MD) antenna modules and an electric dipole (ED) antenna module configured to operate at a nominal wavelength corresponding to an operational frequency band of transmission of electromagnetic (EM) radiation by the antenna system, said MD and ED antenna modules are collinearly arranged along the common axis and are spaced apart from one another along said axis by a distance of a few nominal wavelengths of the operational frequency band thereby providing small dimensions of the antenna system;

said distance being associated with a zone of near field EM coupling between the antenna module and wherein said two locally adjacent antenna modules are characterized by substantially mutually orthogonal polarizations of radiation and by respective toroidal EM radiation patterns coaxial with respect to said common axis so as to provide low gain along said axis, thereby suppressing the near field EM coupling between the antenna modules in said operational frequency band;

at least one signal feeding module associated with at least one of said at least two antenna modules, the signal feeding module defining a transmission line passing through the vicinity of at least one other of said at least two antenna modules, said feeding module comprising an induced current suppression utility adapted for suppressing noise signals induced on said feeding module by said at least one other antenna module, thereby reducing the EM coupling between said at least two antenna modules.

14. An antenna system comprising an array of a certain number of antenna modules arranged in a spaced-apart relation along a common axis;

wherein said array comprises antenna modules of at least two different types, arranged in an alternating fashion along said common axis with distance of few nominal wavelengths corresponding to operational frequency band of transmission of electromagnetic (EM) radiation by the antenna system thereby providing small dimensions of the antenna system; and wherein said distance being associated with a zone of near field EM coupling between the antenna module and said array comprises locally adjacent magnetic dipole (MD) and electric dipole (ED) antenna modules of mutually orthogonal polarizations configured to operate at said nominal wavelength of said operational frequency band; said MD and ED antenna modules are arranged in alternating fashion, such that each two locally adjacent MD and ED antenna modules are arranged along said axis to provide toroidal EM radiation pattern coaxial with respect to said common axis, thereby suppressing the near field EM coupling between the antenna modules.

15. The antenna system of claim 14, comprising at least one signal feeding module associated with at least one of said two antenna modules, the signal feeding module defining a transmission line passing near a central symmetry of the other of said two antenna modules, said feeding module comprising an induced current suppression utility adapted for suppressing noise signals induced on said feeding module by said other antenna module, thereby reducing the EM coupling between said two antenna modules.

16. The antenna system of claim 14, comprising an arrangement of one or more parasitic antenna circuits configured and operable for resonating in frequencies corresponding to said operational frequency band; said one or more parasitic antenna circuits being arranged in the vicinity of said at least two antenna modules for scattering at least some of a residual EM radiation by which said antenna modules are electromagnetically coupled thereby reducing a crosstalk between said antenna modules.

17. The antenna system of claim 16, wherein said one or more parasitic antenna circuits comprise at least one loaded resonance circuit configured and operable for absorbing at least some of said residual EM radiation.

18. The antenna system of claim 16, wherein said arrangement of one or more parasitic antenna circuits is configured and operable for shifting phase of at least a part of the residual EM radiation to cause destructive interference with other parts of said residual EM radiation thereby suppressing said residual EM radiation and reducing a crosstalk between said at least two antenna modules.

19. The antenna system of claim 14, wherein a distance between two locally adjacent antenna modules corresponds to at most five nominal wavelengths of said operational frequency band thereby providing about 30 dB suppression to the EM coupling between the antenna modules.

20. The antenna system of claim 14, characterized by one or more of the following:

a) said two antenna modules are configured for providing substantially mutually orthogonal polarizations with accuracy in the order of 3° thereby reducing the EM coupling between said antenna modules by an order of about 25 dB in at least some portions of said operational frequency band thereby widening the effective frequency band having low EM coupling between said at least two antenna modules;

b) the antenna system comprises an induced current suppression utility configured and operable for reducing coupling between said antennal modules by about 15 dB;

c) an EM coupling between said two antenna modules is below 45 dB over the frequency band of about 10 percent of a central frequency of said operational frequency band;

d) the antenna system comprises an arrangement of one or more parasitic antenna circuits that are configured and operable for dispersing and/or absorbing at least some of the residual EM radiation, to thereby suppress the EM coupling between said two antenna modules by about 5 dB.

* * * * *